US006910359B2

(12) United States Patent
Nelepovitz et al.

(10) Patent No.: US 6,910,359 B2
(45) Date of Patent: Jun. 28, 2005

(54) DIE APPARATUS AND METHOD FOR HIGH TEMPERATURE FORMING OF METAL PRODUCTS

(75) Inventors: Donald Owen Nelepovitz, La Jolla, CA (US); Leo Lawrence Magee, El Cajon, CA (US); Stephen Michael Dowell, Lakeside, CA (US); John Charles Monsees, El Cajon, CA (US)

(73) Assignee: Hi-Tech Welding Services, Inc., El Cajon, CA (US)

( * ) Notice: Subject to any disclaimer, the term of this patent is extended or adjusted under 35 U.S.C. 154(b) by 49 days.

(21) Appl. No.: 10/430,580

(22) Filed: May 6, 2003

(65) Prior Publication Data

US 2003/0209047 A1 Nov. 13, 2003

Related U.S. Application Data

(60) Provisional application No. 60/378,768, filed on May 7, 2002.

(51) Int. Cl.[7] ..... B21D 26/00
(52) U.S. Cl. ..... 72/61; 425/522
(58) Field of Search ..... 72/416, 357, 61, 72/62, 58, 59; 425/522, 525, 523

(56) References Cited

U.S. PATENT DOCUMENTS

| | | | | |
|---|---|---|---|---|
| 3,249,989 A | | 5/1966 | Robinson | |
| 3,409,710 A | * | 11/1968 | Klygis | 264/515 |
| 3,595,047 A | * | 7/1971 | Fanning et al. | 72/58 |
| 3,899,279 A | * | 8/1975 | Hudson et al. | 425/525 |
| 4,319,471 A | | 3/1982 | Benteler et al. | |
| 4,392,602 A | | 7/1983 | Darby | |
| 4,584,860 A | | 4/1986 | Leonard | |
| 4,884,961 A | * | 12/1989 | Iizuka et al. | 425/195 |
| 4,889,276 A | | 12/1989 | Cadwell et al. | |
| 4,988,037 A | | 1/1991 | Cadwell | |
| 5,002,219 A | | 3/1991 | Cadwell | |
| 5,084,963 A | * | 2/1992 | Murray et al. | 29/863 |
| 5,411,699 A | * | 5/1995 | Collette et al. | 264/523 |
| 5,419,171 A | | 5/1995 | Bumgarner | |
| 5,419,791 A | | 5/1995 | Folmer | |
| 5,473,817 A | | 12/1995 | Schnoor | |
| 5,553,474 A | | 9/1996 | Nokajima et al. | |
| 5,649,439 A | | 7/1997 | Schulz | |
| 5,823,034 A | | 10/1998 | Nelepovitz | |
| 6,213,756 B1 | * | 4/2001 | Czesak et al. | 425/525 |

* cited by examiner

*Primary Examiner*—Daniel C. Crane
(74) *Attorney, Agent, or Firm*—Gordon & Rees LLP

(57) ABSTRACT

A die apparatus for forming a high strength metal article under elevated temperature and pressure has at least two opposing die segments together forming a hollow mold chamber for receiving a mold blank between the die segments, the mold chamber having a radial central plane transverse to the longitudinal axis. Each die segment has a plurality of ribs or indents, each rib or indent having a first side facing the central plane and a second side facing away from the central plane. At least the majority of the ribs or indents are of non-uniform shape and have a first and second side at a different angle relative to the central plane, the angle of the second side being greater than the angle of the first side such that the second side is directed generally towards the center of the mold cavity. With this arrangement, when a metal article is molded in the cavity, it will tend to shrink towards the center of the cavity as it cools, in a direction generally along the second sides of the ribs or indents, reducing force acting directly into the ribs or indents.

19 Claims, 3 Drawing Sheets

DIE APPARATUS AND METHOD FOR HIGH TEMPERATURE FORMING OF METAL PRODUCTS

CROSS-REFERENCES TO RELATED APPLICATIONS

This application claims the benefit of priority of U.S. provisional application Ser. No. 60/378,768, filed May 7, 2002, which is incorporated herein by reference in its entirety.

BACKGROUND OF THE INVENTION

1. Field of the Invention

The invention described and claimed herein relates to high temperature forming of metal products particularly for aerospace and similar uses. More particularly it relates to mold structures for such forming.

2. Background Information

Certain metals, such as titanium alloys, exhibit superplasticity at high temperatures. Superplasticity is characterized by the ability of these metals to exhibit tensile elongation far in excess of what other metals can exhibit without exhibiting local necking. Superplastic forming (SPF) methods have primarily been used to form various planar, complex contoured, as well as cylindrical titanium alloy aerospace parts, such as engine intakes, nozzles, combustion chambers and cowlings.

A well-known superplastic metalforming method includes the following steps. First, two titanium sheets are rolled and welded to form two cylinders, a "forming cylinder" and a "slave cylinder," of the same length but slightly different diameters. The forming and slave cylinders are placed concentrically, with the slave cylinder inside the forming cylinder. The upper ends of the forming and slave cylinders are then welded together, as are their lower ends. One or more gas fittings are welded in place along the upper or lowerweld beads. The resulting assembly, known as a preform assembly, thus has a tubular chamber bounded by the inner wall of the forming cylinder, the outer wall of the slave cylinder, and the upper and lower weld beads. The welds seal the chamber gas-tight but for the gas fittings. The preform assembly is then placed over a mandrel, which typically consists of a sturdy steel cylinder having an outside diameter slightly less than the inside diameter of the preform assembly. A multi-piece generally cylindrical die is placed around the preform assembly. The die consists of several sector-shaped segments to allow it to be removed following forming, as described below. One or more containment bands are then placed over the die. It is known that using multiple containment rings spaced from one another rather than a single longer, cylindrical containment band is advantageous because the spaced, less massive rings heat more quickly during the heating step and cools more quickly during the cool-down step of the process. The entire assembly is then placed in a vacuum furnace and heated to a temperature at which the titanium exhibits superplasticity. Inert gas, such as argon, is introduced under pressure into the gas fittings. The gas pressure presses the slave sheet firmly against the mandrel and the forming sheet firmly against the inner surface of the die. The inner surface of the die reflects the desired shape of the part to be formed. The forming sheet thus conforms to the shape of the inner surface of the die. The gas pressure is then relieved and the assembly cooled. When the assembly has cooled, the containment rings and die segments are removed. The upper and lower edges of the formed metal assembly are trimmed to separate the portion that includes the formed part from the remaining portion, which formerly defined the slave sheet, portions of the welds, the gas fittings, handling tabs, and so forth. The formed part may then be further trimmed and finished in any suitable manner.

Another very common SPF method has been used for forming parts that are more planar and less cylindrical. The method is similar to the simple stamping methods that have long been used to form sheet metal parts. A generally flat or planar die half having a generally concave surface that reflects the shape of the part to be formed is placed horizontally in a "hot box" (a frame having a heating element), with the concave surface of the die facing upwardly. A titanium sheet is placed on top of this lower die half. The hot box then heats the titanium sheet to a temperature at which it will exhibit superplasticity. The upper portion of the press clamps down on the sheet/die combination and is brought up to SPF temperature. Gas pressure is applied to the sheet, causing it to form into the die. After forming is complete, the press top is raised and the sheet is removed, followed by immediate insertion of a new sheet, and a repeat of the forming cycle.

It was recognized that it would be desirable to have an SPF method and apparatus that enabled generally planar parts as well as parts of a more cylindrical shape to be formed without requiring the expensive press apparatus as well as more economical tooling. Such a method and apparatus were developed and have been described and claimed in U.S. Pat. No. 5,823,034 issued in 1998.

That invention incorporates a die which includes two or more die segments, each of which is unitarily formed from a suitable non-metallic material. Each die segment has a unitarily formed connecting portion for interlocking it to another die segment. When interlocked in this manner, the interior chamber of the die defines the shape of the part to be formed.

The interlocking of unitarily formed die segments obviates the need for external containment rings. It has been discovered that certain non-metallic materials are generally sufficiently strong to withstand the SPF process without external reinforcement. Moreover, such materials are preferred because they can readily be machined or cast to provide the interior chamber of the die with the desired shape. Other materials having equivalent strength and resistance to thermal expansion and that may be machined, cast or otherwise readily shaped may also be suitable. The absence of massive containment rings, which undesirably act as heat sinks in prior die assemblies, allows the die to heat rapidly during the heating step of the SPF process and cool rapidly during the cooling step. Furthermore, the absence of heavy containment rings facilitates handling of the die apparatus.

In certain embodiments of that invention, the die may swing open and closed on hinges. In such a hinged embodiment, the portions of the die that swing relative to one another each preferably comprise a single die segment, but multiple die segments would also be suitable. The die segments may include tabs, as described above. One or more pins extending through bores at one end of the die may define the hinges. Similarly, one or more pins may be extended through the bores at an opposite end of the die to removably interlock the die segments after swinging the die closed. Thus, the tabs and pins may hingedly interlock the two die portions at one end, and removably interlock the two die portions at an opposite other end.

The die may have any suitable shape, although the shape of the die may reflect the shape of the part to be formed in it. For example, to form a generally planar part, such as a body panel, the die may be generally planar. Similarly, to form a more cylindrical part, such as an exhaust nozzle, the die may be generally cylindrical. Nevertheless, the part may be formed inside the die in any suitable orientation and thus does not dictate the shape of the die.

To use the die in the SPF method, a gas-tight preform is assembled or otherwise provided and then placed inside the die. The preform assembly reflects a generalized shape of the part to be formed, and may be cylindrical for forming generally cylindrical parts or planar for forming generally planar parts. In embodiments in which the method uses a hinged die, a die portion may be lifted or swung open before disposing the preform inside. The die is closed by interlocking one or more connecting portions of the die segments. In embodiments in which the method uses a hinged die, a die portion may be lowered and assembled or swung closed before interlocking the die segments. In embodiments in which the connecting portions of the die segments include bores, a pin is extended through the bores of aligned die segments to interlock them. The die with the preform assembly inside it is then placed into a vacuum furnace and heated. Inert gas is introduced under pressure into the preform assembly, superplastically expanding it and forcing it to conform to the shape of the interior chamber of the die. The gas pressure is then relieved and the assembly cooled. When the assembly has cooled, the die segments are separated. In embodiments in which the method uses a hinged die, the die is swung open. The expanded assembly is then removed from the die and trimmed to separate the portion that includes the formed part from the remaining portion.

Notwithstanding the success of that invention, it has been found that the die structures can be subjected to damaging or destructive stresses during the cooling phase of the SPF process, which shortens the die life and which also can cause distortions in the products formed with a stressed die. The invention described and claimed herein addresses and solves that problem in a unique and highly effective manner, and represents an improvement on the invention defined in the U.S. Pat. No. 5,823,034. The information presented in that patent is relevant to the present invention and its disclosure is therefore incorporated herein by reference.

SUMMARY OF THE INVENTION

It is an object of the present invention to provide a new and improved method and apparatus for high temperature forming of metal products, particularly products incorporating a rib structure.

According to one aspect of the present invention, a die apparatus for forming a part is provided, which comprises at least two opposing die segments together forming a hollow mold chamber for receiving a mold blank between the die segments, the mold chamber having a radial central plane, each die segment having an inner surface having a plurality of ribs or indents, each rib or indent having a first side facing the central plane and a second side facing away from the central plane, each rib or indent of at least the majority of the ribs or indents having a first and second side at a different angle relative to the central plane, the angle of the second side being greater than the angle of the first side. Where the mold chamber has spaced ribs, corresponding stiffener troughs or indents will be formed in the molded product. In contrast, where the mold chamber has indents of shape matching the ribs, the molded product will have corresponding outwardly projecting stiffener ribs.

The ribs in an exemplary embodiment of the invention are generally triangular in shape, but may be of other geometric shapes, such as bowler hat shape, or a flat top rectangular shape, which will produce stiffening in the walls of the product molded in the die apparatus. If there is a rib lying on the central radial plane of the die apparatus, it will have first and second sides at substantially equal angles to the central plane. In an exemplary embodiment of the invention, the angles of the second sides or draft angles, of the ribs increase with distance away from the central plane of the mold, while the angles of the first sides remain substantially the same. The angles of the second sides are predetermined such that, as the molded metal formed in the die cools and contracts, the contracting metal portion against the second side of each rib exerts substantially no damaging force against the rib. The arrangement is such that the force vector angle of that portion of the contracting metal in contact with the second side of the rib is parallel or close to parallel to the surface of that side of the rib, so that the metal tends to move along the rib side and is not forced in towards it with any substantial force. In other words, the second or outer sides of the ribs are angled such that they are directed generally towards the center of the mold chamber, which is the direction in which the contracting metal tends to shrink.

This arrangement reduces the problems in prior art ribbed die surfaces where the ribs were all in the form of isosceles triangles with first and second sides of substantially equal angles. In the case of these prior art dies, when the molding temperatures are quite high, and the differential expansion/contraction rate between the die material and the sheet metal being formed is also high, the contraction of the cooling metal creates lateral pressure against the mold ribs which may damage or even break off the ribs. Since the metal contracts towards the center of the mold as it cools, the lateral pressure is exerted against that side of each rib which faces away from the center, and the pressure increases with distance away from the center of the mold. In the present invention, by providing shaped ribs with sides facing away from the mold center which are of increasing slope with distance away from the center, the effect of the lateral pressure can be alleviated by reducing the force acting against the face of the rib, since the force vector angle will be directed less into the rib and more along the face of the rib, i.e. closer than the actual direction of travel of the metal as it contracts.

This apparatus is particularly intended for cases where the molding temperatures are quite high and the difference in thermal expansion/contraction rate between the mold material and the metal being molded is also quite high. This is true for metals such as titanium, titanium alloys and the like. The rib or rib structures may be completely or partially circumferential or completely or partially helical within the die chamber, and the rib structures may have any desired pattern, with the pattern being uniform within the die chamber or varying in different portions of the apparatus. In addition to ribs extending around the mold chamber in a direction generally transverse or at an angle relative to the longitudinal axis of the chamber, where the chamber is elongated, diametrically opposed ribs may extend lengthwise along the chamber, crossing the remaining ribs or rib structures, to form corresponding ribs in the molded product. These longitudinal ribs may be of isosceles triangle shape and do not need to have opposite sides at different angles, since the direction of shrinkage of the metal on cooling will be generally along the side surfaces, and will not apply force into the rib sides.

If there is a rib structure which coincides with the central radial plane of the mold cavity, this will have opposite sides of equal angle. Apart from any such rib structure, all other rib structures spaced away from the central radial plane will have opposite sides at different angles, with the side facing the central plane generally being parallel or close to parallel to the central plane, and the side facing away from the central plane being at an angle relative to the central plane which increases with distance away from the central plane, such that the differential slope angles of the rib structures on each side of the central plane towards the opposite ends of the chamber are mirror images of each other.

According to another aspect of the present invention, a method for molding high strength metals under high pressure is provided, which comprises the steps of:

providing a mold blank comprising first and second planar metal sheets of the same size periphery, aligned in a co-planar orientation, and having a continuous weld bead along the periphery of the metal sheets, with a gas fitting at a position between the first and second sheets for gas injection into the mold blank;

providing an openable mold comprising opposed dies having interior surfaces forming a hollow mold chamber for receiving and molding the blank, the mold chamber having a plane of separation between the opposed dies and a central radial plane transverse to the plane of separation, each die having a plurality of ribs or indents, each rib or indent which is not located at the central radial plane being slanted towards the central radial plane of the chamber, the amount of slant of each rib or indent being dependent on the distance of the rib or indent from the central radial plane and generally increasing with distance from the central radial plane;

inserting the mold blank between the opposed dies such that it lies on said plane of separation with the gas fitting projecting outside the dies and closing the dies to contain the blank within the mold chamber;

heating the mold and contained blank to an operational molding temperature;

pumping pressurized gas into the interior of the heated blank and expanding the blank outwardly to conform to the shape of the interior surfaces of the opposed dies, with portions of the blank contacting and being formed around the ribs or indents so as to form corresponding indentations or ribs, respectively in the sheets forming the blank;

allowing the mold and molded blank to cool, relieving gas pressure; and removing the resultant metal article from the mold.

The amount of slant of the ribs or indents increases with distance from the central plane such that, as the molded metal cools and contracts within the chamber, the contracting metal portion against the outer face of each rib or indent relative to the central radial plane of the chamber tends to apply little or no force onto the rib, or indent such that the risk of damage to the ribs or indents as a result of differential rates of thermal contraction of the molded article and mold is reduced or eliminated. Each rib or indent which is not at or close to the central radial plane of the mold cavity is formed as an asymmetrical shape, with the side of the rib facing the central radial plane generally being at a steeper angle, relative to the central plane, than the side facing away from the central radial plane. The inner sides of the ribs or indents may be vertical or close to vertical, i.e. generally parallel with the central radial plane. As noted above, this means that the outer sides of the ribs or indents are more slanted, or more angled relative to the central plane, so that the force vector angle resulting from the metal shrinkage is not directed transverse to the side surface, but more along the side surface of the rib or indent.

With the rib or indent arrangement of this invention, the amount of force exerted against the outer side of each rib or indent is sufficiently low that there is little risk of the rib or indent being damaged, deformed, scored or broken as a result of the metal shrinkage against the rib. This invention therefore will increase the lifetime of a die apparatus since the risk of damage to the ribs or indents in the opposing die parts is reduced or eliminated. This also reduces the risk of distortions in the products formed in a stressed die, increasing production and efficiency.

BRIEF SUMMARY OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
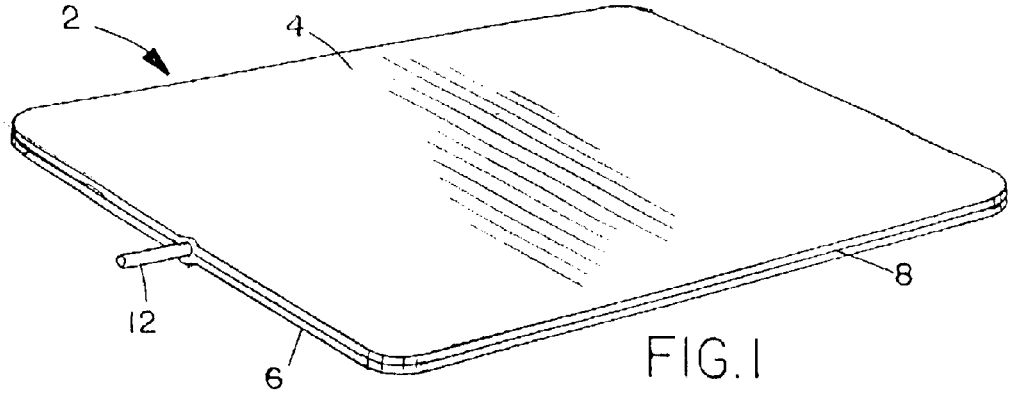
FIG. 1 is an oblique view of a product blank before forming, the blank being the same as those used in the previously patented system.

The invention is most easily understood by reference to the drawings, taken in conjunction with the following description. With high temperature superplastic molding of sheet metal, where the material of the die is different from the metal being molded, it is not uncommon for the two materials to have different coefficients of expansion and contraction. When the die and metal sheet are being heated, the differential expansion is not a factor, since the metal sheet is deforming into the mold as it heats. This metal deformation is primarily accommodated by thinning of the metal sheet as it expands and conforms to the mold's interior configuration. When the metal and die are subsequently cooled, however, the differential contraction causes the metal to shrink away from the mold's interior surface and toward the center of the mold.

We have discovered, however, that when the mold's interior surface has projections protruding from the surface into the interior of the mold, the differential shrinkage of the sheet metal upon cooling can damage those projections. As an example, consider a mold which is to be used for formation of a hollow sheet metal vessel, such as a water tank. To maintain the integrity and shape of the finished tank when filled with water, it is desirable to mold ribs into the tank wall (i.e., into the sheet metal). Such ribs can be formed in the finished tank by having the opposite rib shapes (i.e., a "negative") formed in the interior surface of the mold. When the sheet metal blank for the tank (commonly in the form of two adjacent sheets of the same size welded together over most of their common perimeter) is heated in the die and expanded by pumping gas into the space between the sheets, the heat-softened sheets expand outward and conform to the interior surface of the die, so that the shaped ribs of the product (i.e., the "positive") are formed as the metal deforms around the negative die ribs. Such negative mold ribs may be completely or partially circumferential, helical, longitudinal, etc. within the die, or there may be different rib patterns within different portions of the die, all of which impart corresponding positive rib patterns to the product.

In conventional molds, negative ribs or projections from the interior surface of the die part all have a relatively narrow vertical cross-sectional profile, with each longitudinal side of a rib rising abruptly and equally from the mold's interior surface at a high angle to meet at a rounded peak, to form a profile of an inverted generally isosceles U- or V-shape (i.e., ∩ or Λ). With the exception for conformance of size as the interior profile of the die varies from end to end or side to side, or where various areas of the die are intended to impart surfaces at different angles to each other in the formed product, all ribs within an area of the die, or over the entire die, rise substantially perpendicularly from the interior surface of the die and are substantially parallel to their close neighbors. The finished tank or similar molded product is thus formed with opposite positive ribs, all of which also have the same isosceles cross-sectional profile. This works well for metals that can be thermoformed at relatively low temperatures and where the differential expansion/contraction rate between the die material and sheet metal is low.

We have discovered, however, that when the molding temperatures are quite high, such as is required for molding metals such as titanium or titanium alloys, and the differential rates are high, the contraction of the cooling metal tank walls creates lateral pressures against the mold's negative ribs and can damage or even break off such negative ribs. Since the metal contracts toward the center of the mold as it cools, the lateral pressure is exerted against that side of each rib which faces away from the center, and the pressure exerted on ribs increases the farther each rib is from the center of the mold. Thus ribs closer to the end of a cylindrical mold, for instance, are under much greater lateral pressure than those which are at or near the longitudinal center or central radial plane of the mold.

We have solved the problem of damage to such negative mold ribs from contraction of the cooling metal by the present invention by developing a unique negative rib configuration for a die. In our invention, the cross-sectional profiles of the ribs are not uniform nor, except for ribs at or near the center of the mold, isosceles in shape. Rather, the ribs in the mold of our invention have a cross-sectional profile which has a more vertical slope on the side facing the center than on the side facing away from the center. Further, the differential slope angles between the two sides increases the farther away from the center of the mold a specific rib is positioned, and the progression of the slopes toward the two ends from the center of the mold are essentially mirror images of each other.

The degree of slope or draft angle of the side of the rib away from the center of the mold is the critical portion of the profile. The angle of the side toward the center is usually vertical or close to vertical (i.e. having slight relief), but the specific angle is not critical, and can be molded as convenient. Also, conveniently all of the center-facing-side angles will be the same to simplify mold production. The preferable respective slope of the side facing away from the center (which can be referred to as "end-facing") for any specific rib can be readily calculated to be such that as the metal cools and contracts toward the middle, the resultant force vector angle of that portion of the contracting metal in contact with that side of the rib is parallel to the surface of the side, so that the metal moves along the rib side and is not forced in toward it. As a practical matter, the actual vector angle need not be exactly parallel, but can be slightly toward the side surface, so that there is some sliding contact and urging toward the rib surface, but the amount of force exerted against the rib side is sufficiently low that the rib is not at risk of being deformed or broken off and the potential for scoring of the sheet metal surface is minimized. The numerical range of slope angles may be a function of the number of ribs, their positioning within the mold, the length of the mold, the differential contraction rates, and other parameters which will be evident to those skilled in the art.

Figure 2A:
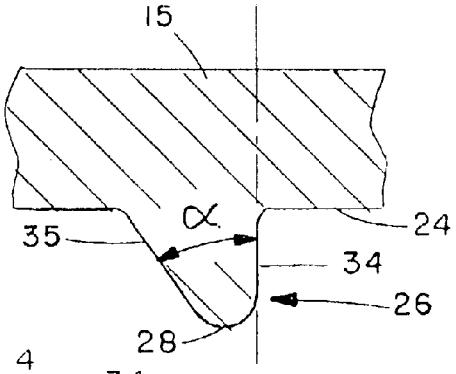
FIG. 2A is an enlarged view of one rib of FIG. 2, illustrating the rib shape in more detail.
Figure 2:
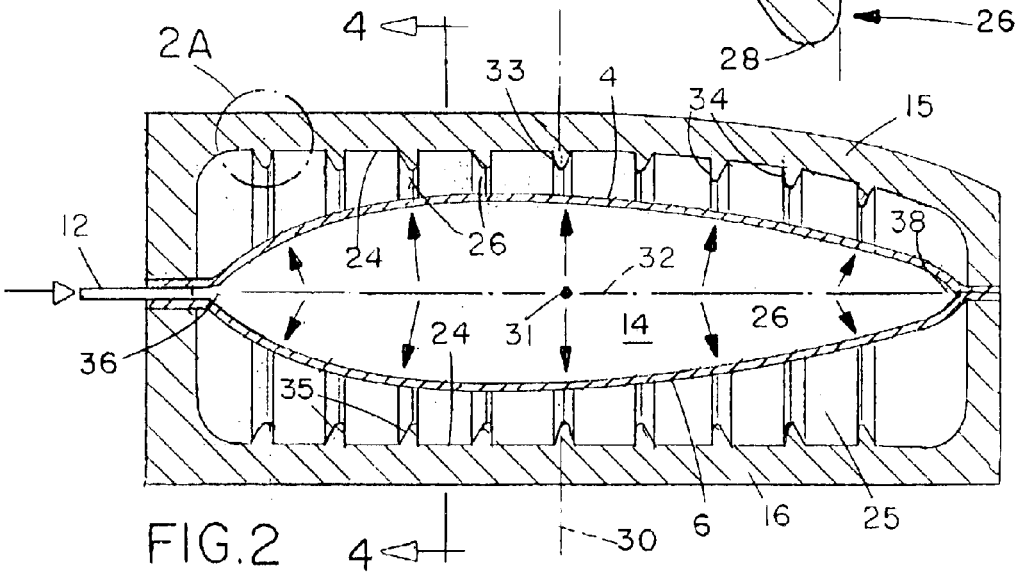
FIG. 2 is a cross-sectional elevation view through a closed die apparatus according to an exemplary embodiment of the present invention, showing a blank of FIG. 1 being expanded into the die for forming of the desired product, also showing the unique negative rib structure of the die.

Referring then to the Figures of the drawings, a blank 2 to be molded in a die of the present invention to form the desired product is illustrated in FIG. 1. The blank 2 is composed of two generally flat sheets 4 and 6 which are substantially coextensive and are joined at a peripheral seal 8 to form a fluid (gas or liquid) tight seal as by a weld bead or other means of maintaining the fluid-tight integrity under the molding conditions of high temperature and pressure and subsequently under service conditions of the finished product, which may themselves include extremes of temperature and/or pressure in fields such as aerospace. Also present will be a gas supply tube 12 penetrating through the peripheral seal 8 to allow the flow of pressurized gas into the hollow interior 14 between the sheets 4 and 6, as best seen in FIG. 2. This general description of the blank 2 is sufficient for the purposes of the present invention, which is directed to the die structure. For a more detailed description of the blank 2, reference should be made to the U.S. Pat. No. 5,823,034.

Figure 3:
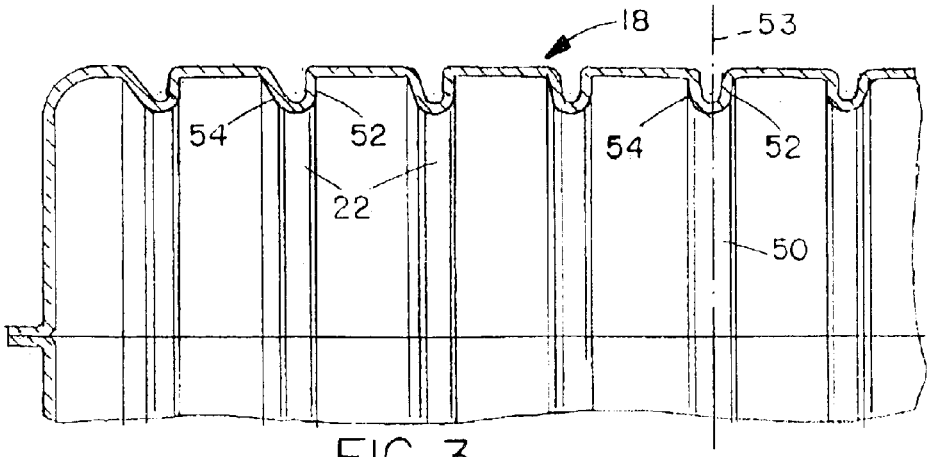
FIG. 3 is a partial longitudinal cross-sectional view of a product formed in the die of FIG. 2, illustrating the unique positive rib structure imparted by the die.
Figure 7:
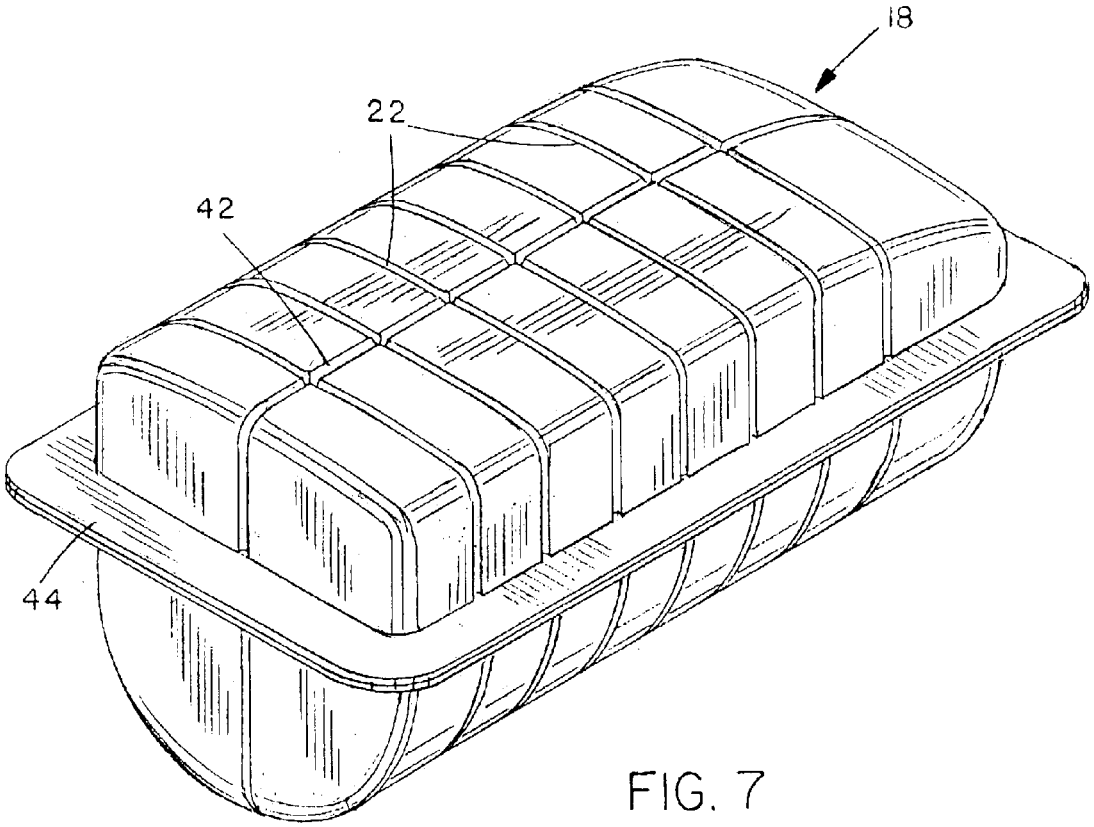
FIG. 7 is a perspective view of an exemplary product formed by a die apparatus of the present invention, namely a container for water, fuel or other liquids or gases.

The unique negative rib structure of the die according to one embodiment of the present invention is best seen in FIG. 2 and the resulting positive rib structure of the product 16 is best seen in FIGS. 3 and 7. FIG. 2 illustrates a longitudinal vertical cross section through a die apparatus according to a first exemplary embodiment of the invention, illustrating the blank 2 in position between two die segments 15, 16 of the apparatus at an intermediate point in the molding process. The die is formed of any suitable non-metallic material. FIG. 3 illustrates part of an end product 18 formed by the apparatus of FIG. 2. The apparatus of FIG. 2 is designed to form a water tank, for example an aircraft water tank 18 of titanium or titanium alloy, as illustrated in FIG. 7, having spaced, generally circumferential ribs 22 projecting inwardly into the interior of the tank, as indicated in FIGS. 3 and 7, for added strength. It will be understood that the number and arrangement of the ribs may vary from that shown in the drawings, and the ribs may be circumferential, part circumferential, helical, or partially helical.

Figure 4:
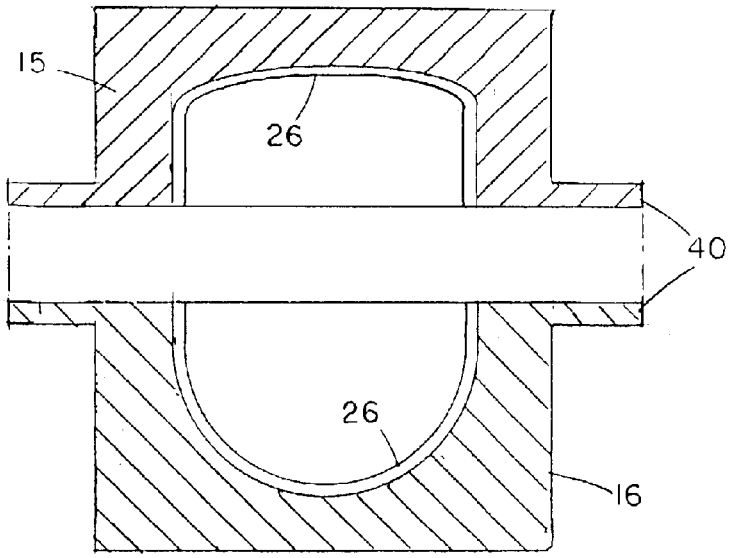
FIG. 4 is a vertical cross-sectional view of one embodiment of the die of the invention, illustrating that products with non-uniform cross-sections can be formed by the present invention.

The mold or die apparatus of FIG. 2 comprises two die halves or parts 15,16 which have interior surfaces 24 which together form a mold cavity 25. The interior surfaces 24 of the die parts may be of any desired shape, dependent on the shape of the part or article to be formed, and the two halves may be of non-uniform cross-section, as illustrated in FIG. 4, which is a cross-section on the lines 4—4 of FIG. 2. As indicated in FIG. 4, the upper part 15 of the apparatus has a more rectangular internal cross-section, while the lower part 16 has a more rounded internal shape. As best illustrated in FIG. 2, each die part has a series of projections on its interior surface 24, which in this case comprise ribs 26 which project inwardly into the die cavity. The ribs 26 are designed to form a corresponding rib structure 22 on the inside of the formed tank or article 18, as will be explained in more detail below. Each rib 26 is of generally triangular shape, with a rounded apex 28, and the triangular shape varies from rib to rib based on distance from the central radial plane 30 of the mold cavity, i.e. the plane extending through the center 31 of the mold cavity in a direction transverse to the dividing line or plane 32 between the two mold parts. The apex 28 of each rib may be less rounded and more v-shaped in other embodiments. Other geometrical rib shapes may alternatively be used for forming stiffening ribs in the end product, such as bowler-hat shaped ribs, or rectangular ribs.

Figure 2B:
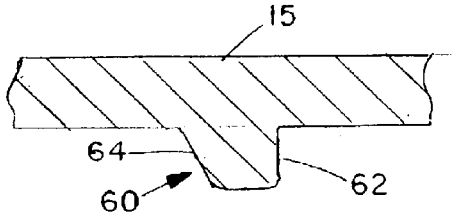
FIG. 2B is a view similar to FIG. 2A illustrating a modified rib shape.

Each rib 26, apart from any rib such as rib 33 lying on or close to the central plane 30, has a first side 34 facing the central plane 30 and a second side 35 facing away from the central plane and towards the respective end 36 or 38 of the cavity, with the two sides 34,35 being oriented at different angles to form an asymmetric or non-isosceles triangle shape. The central rib 33, if any, will be of substantially isosceles, uniform shape, as will any other ribs which are located very close to the central plane 30. The ribs in the exemplary embodiment, apart from any central rib 32, have a non-uniform cross-sectional profile, and each have a first side 34 which is at or close to vertical as viewed in FIG. 2, i.e. parallel to or at a relatively small angle to the central plane 30. The angles of the second side 35 relative to the central plane are greater than the first side angle, and increase with distance away from the central radial plane, as can be seen in FIG. 2. Thus, the ribs closest to each end of the cavity 25 have the largest slant angle a in the second side 35. The angles of the second sides of the ribs are arranged such that these sides are slanted or angled in a direction generally towards the center 31 of the mold cavity. It will be understood by those skilled in the art that the numerical range of slope angles of the second sides of the ribs will be dependent on the number of ribs, the spacing between adjacent ribs, and the length and other dimensions of the mold cavity. As noted above, the ribs need not necessarily be triangular in shape, but may be of any suitable shape which will have a stiffening effect, such as bowler hat shape, or a rectangular rib 60 as illustrated in FIG. 2B. However, regardless of the general rib shape, the draft angle or angle of the outer face of the ribs will increase with distance from the center of the mold. The rectangular rib 60 of FIG. 2B also has a first side 62 which faces the center of the cavity which is at or close to vertical, and a second side 64 which faces away from the center, and which has a slant or draft angle which increases from rib to rib with distance from the center, as with side face 35 of FIGS. 2 and 2A.

Figure 6:
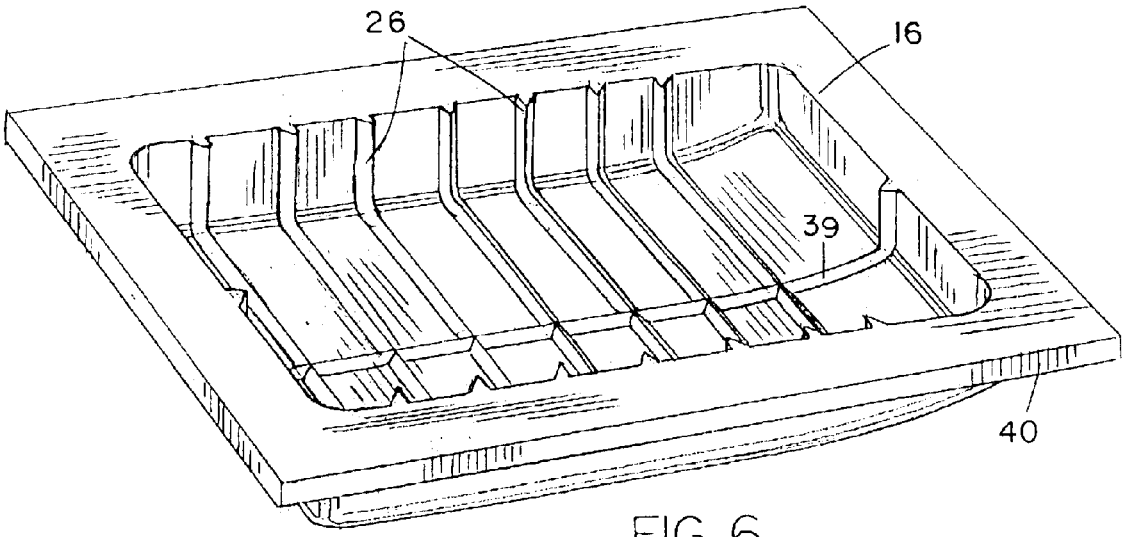
FIG. 6 is a perspective view of one part of the die apparatus of FIG. 2.

In addition to the ribs which extend generally circumferentially, helically, or transverse to the longitudinal axis of the mold, there may be additional ribs which extend longitudinally, such as rib 39 illustrated in the mold part 15 in FIG. 6. The shrinking of the metal on cooling will be along the side faces of any such rib, and it may therefore be of a uniform, isosceles triangle shape. Other mold projections may also be provided, depending on the desired ending shape or pattern of the walls of the molded article. In general, any projection which is elongated in a direction generally parallel or close to parallel to the central radial plane of the mold will be designed to have a larger angle of inclination relative to the central plane in its face which faces away from the central radial plane, so that it is sloped generally towards the center of the mold cavity.

In order to form an article using the die apparatus of FIGS. 2,4 and 6, the die parts are first opened or separated, and the blank 2 is placed between the die parts before closing the die to grip the perimeter of the blank between the opposing peripheral rims of the die parts. As illustrated in FIGS. 4 and 6, the die parts may each have an outwardly projecting, peripheral flange 40 for mechanically locking the die sections together during the molding process. The die parts may be secured together using any suitable mechanical fasteners. Once the die parts are secured together with their peripheral rims and flanges in face to face engagement, the blank extends across the mold cavity along the dividing plane between the die parts. The die apparatus is then heated to the desired molding temperature, and pressurized gas is injected into the space between the two sheets 4 and 6 of the blank, via the gas supply tube or conduit 12. The pressurized gas will force the two sheets to expand in the direction of the arrows in FIG. 2, so that the sheets are eventually pressed against the internal surfaces 24 of the two die parts, conforming to the inner surface shape of the die. The heated, softened metal sheets will form around the ribs in the die parts, forming indents of corresponding shape on the outer surface and ribs of corresponding shape on the inner surface of the article being molded.

The die apparatus is then allowed to cool and the supply of pressurized gas is turned off. The formed article will also cool down, and will contract within the mold chamber as it cools. The contracting metal which is in contact with the outwardly facing sides of the respective ribs will tend to move along the rib side, due to the slant or angle of that side of the rib which directs or slants the rib more towards the center of the mold, which is the direction in which the metal of the article being molded will tend to shrink. In general, the slope of the respective rib sides facing away from the center of the mold cavity can be calculated to be such that, as the metal cools and contracts, the amount of force directed against the rib side is reduced to a level such that the risk of damage, breaking, or deforming of the rib is substantially reduced or eliminated. There may be a small amount of force exerted against the rib side, but this is low enough that damage is unlikely to occur. As noted above, the numerical range of slope angles from the center to the outer ends of the mold cavity will be a function of the number of ribs, the rib dimensions, the rib positioning in the mold, the length of the mold, the differential contraction rates between the mold material and the metal to be formed, and the molding temperature. Typical types of metals, molding temperatures, and other operational parameters will be known to those skilled in the art or may be determined from the aforementioned U.S. Pat. No. 5,823,034.

When the formed article within the mold has cooled sufficiently, it can be removed from the mold. As illustrated in FIGS. 3 and 7, the molded article will have circumferential and longitudinal ribs 22,42 corresponding to the ribs 26, 39 in the mold chamber. The formed article or tank in FIG. 7 has an outwardly projecting peripheral flange 44 along the parting line of the article. As best illustrated in FIG. 3, the ribs 22 formed in the inner wall of the tank will have non-uniform shapes matching those of the ribs 26 around which they were formed. Central rib 50 will be of uniform, isosceles triangle shape matching the central rib 33 in the die apparatus. Each rib 22 will therefore have a first side 52 facing the center which is more or less vertical or parallel to the central plane 53, and a second side 54 facing away from the center which is inclined at an angle which increases with distance away from the center of the tank.

Figure 5:
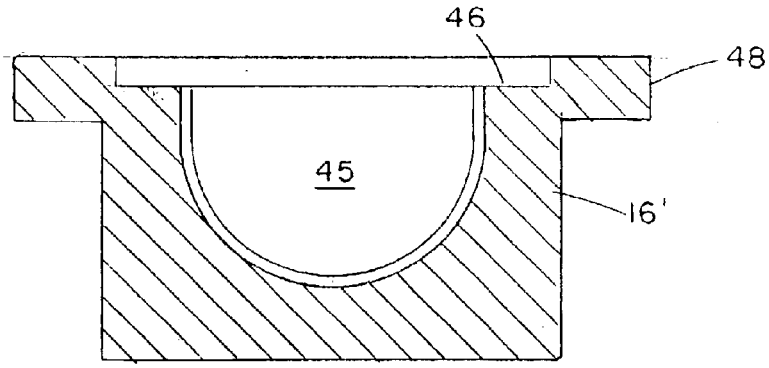
FIG. 5 is a vertical lateral cross-sectional view of a modified version of the die embodiment of FIG. 4, illustrating means for forming a peripheral flange at the parting line of the formed product.

FIG. 5 illustrates one part 16' of a modified die apparatus for forming a peripheral flange in the finished article, e.g. flange 44 of FIG. 7. In this embodiment, the part 16' defines part 45 of a mold cavity of similar shape to the die part 15 of FIG. 4. However, an annular shoulder or recess 46 is formed around the periphery of the cavity 45. A matching annular shoulder will be formed about the periphery of the cavity or recess in the opposing die part (not illustrated). When the two die parts are secured together with their outwardly projecting, peripheral flanges 48 in face to face engagement, the resulting mold cavity will have an outwardly projecting groove around its periphery defined between the opposing annular recesses 46. The blank material will extend into the groove to form the peripheral flange 44 along the parting line between the two sheets forming the end product.

Figure 8:
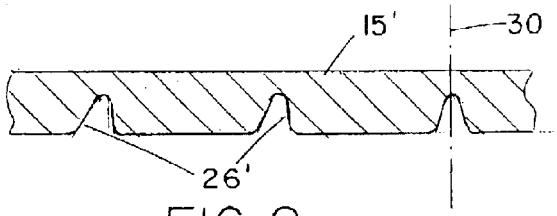
FIG. 8 is a partial cross-sectional view of part of one half of a modified die apparatus having indents rather than ribs.

FIG. 8 illustrates a portion of a modified die part 15', in which the ribs 26 are replaced by similarly shaped indents 26'. It will be understood that the ribs in the other die part will be replaced by similar indents. As with ribs 26, the indents will have outer side faces with angles which increase with distance from the center of the mold cavity. These will form outwardly projecting ribs on parts molded in the die apparatus, having an equivalent strength to the indented rib formations on tank 18 of FIG. 7.

The die apparatus and molding method of this invention is particularly designed for molding high strength metals under high pressures and at high temperatures. Although there are only two die parts in the illustrated embodiments, it will be understood that the die cavity may be formed from more than two interlocking die parts or segments in other embodiments. Regardless of the number of die parts, any ribs or projections extending into the mold cavity will have the characteristics described above for alleviating force on the outermost surfaces of such ribs or projections when the molded metal is cooling and shrinking. In other words, the triangular ribs will have outer sides facing away from the center of the mold which are slanted more and more towards the mold center with distance away from the center. With this arrangement, forces on the ribs due to metal shrinkage on cooling will be reduced, since such forces will be directed more along the outer side surfaces of the ribs and less directly into the ribs. Unlike conventional ribbed surfaces of die parts, which typically are of uniform, isosceles triangle cross section, the ribs in this invention will have significantly less force applied to them as the metal of the formed part is cooling, and will be less likely to be damaged, broken, deformed, or scored. This will increase the die lifetime, reducing replacement costs, and will provide more uniform products.

We claim:

1. A die apparatus for forming a high strength metal article under elevated temperature and pressure, comprising:

at least two opposing die segments together forming a hollow mold chamber for receiving a mold blank between the die segments, the mold chamber having a longitudinal axis and a radial central plane transverse to the longitudinal axis;

each die segment having an inner surface having a plurality of spaced, elongate formations extending in a direction non-parallel to the longitudinal axis, each formation having a first side facing the central plane and a second side facing away from the central plane;

at least the majority of the formations comprising non-uniform formations in which said first side and said second side are at different angles relative to the central plane, the angle of the second side being greater than the angle of the first side; and the formations including at least one uniform formation located at least approximately at the radial central plane.

2. A die apparatus for forming a high strength metal article under elevated temperature and pressure, comprising:

at least two opposing die segments together forming a hollow mold chamber for receiving a mold blank between the die segments, the mold chamber having a longitudinal axis and a radial central plane transverse to the longitudinal axis;

each die segment having an inner surface having a plurality of spaced, elongate formations extending in a direction non-parallel to the longitudinal axis, each formation having a first side facing the central plane and a second side facing away from the central plane; and at least the majority of the formations comprising non-uniform formations in which said first side and said second side are at different angles relative to the central plane, the angle of the second side being greater than the angle of the first side; and additional formations extending parallel to the longitudinal axis, the additional formations being of uniform shape.

3. A die apparatus for forming a high strength metal article under elevated temperature and pressure, comprising:

at least two opposing die segments together forming a hollow mold chamber for receiving a mold blank between the die segments, the mold chamber having a longitudinal axis and a radial central plane transverse to the longitudinal axis;

each die segment having an inner surface having a plurality of spaced, elongate formations extending in a direction non-parallel to the longitudinal axis, each formation having a first side facing the central plane and a second side facing away from the central plane; and at least the majority of the formations comprising non-uniform formations in which said first side and said second side are at different angles relative to the central plane, the angle of the second side being greater than the angle of the first side; and the angle of the second side of each non-uniform formation being predetermined as a function of distance from the radial central plane, the non-uniform formations having second side angles which increase with distance of the respective formation from the radial central plane.

4. The apparatus as claimed in claim 3, wherein the formations comprise ribs.

5. The apparatus as claimed in claim 3, wherein the formations comprise indents.

6. The apparatus as claimed in claim 3, wherein the formations extend substantially transverse to the longitudinal axis of the mold chamber.

7. The apparatus as claimed in claim 3, wherein a plurality of non-uniform formations are located at spaced intervals on opposite sides of the radial central plane, and the progressions of the slopes of the second sides of the formations in opposite directions from the radial central plane are mirror images of each other.

8. The apparatus as claimed in claim 3, wherein the first side of each formation is substantially parallel to the radial central plane.

9. The apparatus as claimed in claim 3, wherein the formations extend in substantially helical paths around said mold chamber.

10. The apparatus as claimed in claim 3, wherein the formations extend in substantially circumferential paths around said mold chamber.

11. The apparatus as claimed in claim 3, wherein formations are generally triangular in shape.

12. The apparatus as claimed in claim 3, wherein the formations are generally rectangular in shape.

13. A die apparatus for forming a high strength metal article under elevated temperature and pressure, comprising:

at least two opposing die segments together forming a hollow mold chamber for receiving a mold blank between the die segments, the mold chamber having a center and a radial central plane extending through the center of the mold chamber;

each die segment having an inner surface having a plurality of elongate formations of generally triangle-shaped cross section facing into the interior of the mold chamber, and at least the majority of the formations being of non-uniform, non-isosceles triangle shape;

each non-uniform formation being spaced from said radial central plane, a first set of formations being located at spaced intervals between said central plane and one end of the chamber, and a second set of formations being located at spaced intervals between the central plane and opposite end of the chamber;

each non-uniform formation having a first side facing said central plane and a second side facing away from said central plane, and said first and second sides being at different angles relative to said central plane, the second sides being at a larger angle to said central plane than said first sides; and the angles of the second sides of said formations in each set increasing with distance from said central plane, the two sets of formations being mirror images of each other.

14. The apparatus as claimed in claim 13, wherein the second sides of said formations in each set are each at a predetermined angle such that said second sides are directed generally towards the center of said mold chamber.

15. The apparatus as claimed in claim 13, wherein the mold chamber has a longitudinal axis and the radial central plane is transverse to the longitudinal axis, the non-uniform formations extending in a direction which is not parallel to the longitudinal axis.

16. The apparatus as claimed in claim 13, wherein the elongate formations comprise ribs.

17. The apparatus as claimed in claim 13, wherein the elongate formations comprise indents.

18. A die apparatus for forming a high strength metal article under elevated temperature and pressure, comprising:

at least two opposing die segments together forming a hollow mold chamber for receiving a mold blank between the die segments, the mold chamber having a center and a radial central plane extending through the center of the mold chamber;

each die segment having an inner surface having a plurality of elongate formations of generally triangle-shaped cross section facing into the interior of the mold at least the majority of the formations being of non-uniform, non-isosceles triangle shape; and at least one formation located substantially at said central plane, said one formation being of uniform isosceles triangle shape.

19. A die apparatus for forming a high strength metal article under elevated temperature and pressure, comprising:

at least two opposing die segments together forming a hollow mold chamber for receiving a mold blank between the die segments, the mold chamber having a longitudinal axis and a radial central plane extending transverse to the longitudinal axis;

each die segment having an inner surface having a plurality of elongate formations facing into the interior of the mold chamber, the elongate formations extending in a direction non-parallel to the longitudinal axis; and the formations having angled faces of slope which increases progressively with distance of the respective formation away from the radial central plane.

* * * * *